US010205305B2

(12) United States Patent
Uegaki et al.

(10) Patent No.: US 10,205,305 B2
(45) Date of Patent: Feb. 12, 2019

(54) SPARK PLUG

(71) Applicant: NGK SPARK PLUG CO., LTD., Nagoya, Aichi (JP)

(72) Inventors: Hironori Uegaki, Nagoya (JP); Hirokazu Kurono, Nagoya (JP); Jumpei Kita, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/738,510

(22) PCT Filed: May 24, 2016

(86) PCT No.: PCT/JP2016/002517
§ 371 (c)(1),
(2) Date: Dec. 20, 2017

(87) PCT Pub. No.: WO2016/208118
PCT Pub. Date: Dec. 29, 2016

(65) Prior Publication Data

US 2018/0175592 A1 Jun. 21, 2018

(30) Foreign Application Priority Data

Jun. 22, 2015 (JP) ..... 2015-124318

(51) Int. Cl.
*H01T 13/34* (2006.01)
*H01T 13/41* (2006.01)
*H01T 13/20* (2006.01)

(52) U.S. Cl.
CPC ..... *H01T 13/34* (2013.01); *H01T 13/20* (2013.01); *H01T 13/41* (2013.01)

(58) Field of Classification Search
None
See application file for complete search history.

(56) References Cited

U.S. PATENT DOCUMENTS 6,160,342 A * 12/2000 Nishikawa ..... H01T 13/41 313/136
2013/0285534 A1* 10/2013 Ochiai ..... H01T 13/05 313/141

(Continued)

FOREIGN PATENT DOCUMENTS

WO 2012-105255 A1 8/2012
WO 2013-031232 A1 3/2013

OTHER PUBLICATIONS

Japan Patent Office, International Search Report issued in corresponding Application No. PCT/JP2016/002517, dated Aug. 9, 2016.

(Continued)

*Primary Examiner* — Ashok Patel
(74) *Attorney, Agent, or Firm* — Stites & Harbison, PLLC; Jeffrey A. Haeberlin; James R. Hayne

(57) ABSTRACT

A spark plug including a metal shell having a ground electrode, a cylindrical ceramic insulator held in the metal shell and having therein an axial hole having a small-diameter portion, and a large-diameter portion larger in diameter than the small-diameter portion and connected to a rear end of the small-diameter portion via a stepped portion, a resistor arranged in the large-diameter portion, a center electrode having: a flange portion projecting in a radial direction in the large-diameter portion to contact with the stepped portion; and a leg portion arranged in the small-diameter portion so as to extend from the flange portion toward the front end side, and a seal body arranged in the large-diameter portion and electrically connecting between the center electrode and the resistor. The seal body includes an insulating seal body that comes into contact with the ceramic insulator, and a conductive seal body.

5 Claims, 4 Drawing Sheets

(56) References Cited

U.S. PATENT DOCUMENTS

| | | | | |
|---|---|---|---|---|
| 2013/0307402 | A1 | 11/2013 | Yoshida et al. | |
| 2014/0210335 | A1* | 7/2014 | Fujimura | H01T 13/34 313/141 |
| 2015/0162725 | A1* | 6/2015 | Yamada | H01T 13/32 313/141 |
| 2015/0349498 | A1* | 12/2015 | Takaoka | H01T 13/41 313/135 |

OTHER PUBLICATIONS

Japan Patent Office, Written Opinion issued in corresponding Application No. PCT/JP2016/002517, dated Aug. 9, 2016.

* cited by examiner

SPARK PLUG

TECHNICAL FIELD

The present invention relates to a spark plug.

BACKGROUND ART

A spark plug is a component that generates spark discharge in order to ignite an air-fuel mixture in a combustion chamber. As a structure of the spark plug, there is known a structure that includes: a ceramic insulator in which an axial hole is provided so as to extend along an axis; a metal shell that holds the ceramic insulator therein; a center electrode held in the axial hole; and a conductive seal body for holding the center electrode in the axial hole (Patent Document 1). In the case of the structure disclosed in Patent Document 1, the center electrode includes a flange portion projecting in a radial direction, and a head portion protruding from the flange portion toward a rear end side, and by using this structure, the center electrode is held in the ceramic insulator. Specifically, by the flange portion abutting against a stepped portion provided in the axial hole, the center electrode is prevented from moving toward a front end side. In addition, by the seal body being filled into a portion around the head portion and the flange portion, impact resistance of the center electrode is secured, whereby loosening of the center electrode is less likely to occur even when the center electrode is subjected to impact by combustion.

PRIOR ART DOCUMENT

Patent Document

Patent Document 1: International Publication No. 2012/105255

SUMMARY OF THE INVENTION

Problem to be Solved by the Invention

In the spark plug, durability of the electrode against the repeated spark discharge is required. In order to improve the durability, reduction of an electrostatic capacity between the metal shell and a conductor arranged in the ceramic insulator is effective. The conductor is the seal body or the center electrode. The reduction of the electrostatic capacity is achieved by, for example, shortening the head portion and correspondingly reducing the height of the seal body in an axial direction. However, when the head portion is shortened, a holding force by the seal body may be lowered to reduce the impact resistance of the center electrode, whereby loosening of the center electrode is likely to occur. The present invention is made in view of the above situation, and an object of the present invention is to achieve both reduction of the electrostatic capacity and securing of the impact resistance of the center electrode.

Means for Solving the Problem

The present invention has been made to solve the above-described problem, and can be embodied in the following aspects.

(1) According to an aspect of the present invention, a spark plug is provided which includes: a metal shell having an almost cylindrical shape and having a ground electrode on a front end side thereof; a cylindrical ceramic insulator having an axial hole therein and held in the metal shell, the axial hole having a small-diameter portion, and a large-diameter portion that is larger in diameter than the small-diameter portion and that is connected to a rear end of the small-diameter portion via a stepped portion; a resistor arranged in the large-diameter portion; a center electrode having a flange portion and a leg portion, the flange portion projecting in a radial direction in the large-diameter portion to contact with the stepped portion, the leg portion arranged in the small-diameter portion so as to extend from the flange portion toward the front end side; and a seal body arranged in the large-diameter portion and electrically connecting between the center electrode and the resistor. In the spark plug, the seal body includes a conductive seal body, and an insulating seal body that comes into contact with the ceramic insulator. According to this aspect, since the seal body includes the conductive seal body and the insulating seal body that comes into contact with the ceramic insulator, the conductive seal body can be reduced in weight while the conductive seal body and the insulating seal body hold the center electrode. Thus, an electrostatic capacity can be reduced while securing impact resistance of the center electrode.

(2) In the above aspect, the insulating seal body may come into contact with a forward facing surface of the conductive seal body. According to this aspect, the electrostatic capacity can be reduced by securing an area of contact with the ceramic insulator in a height direction.

(3) In the above aspect, a specific dielectric constant of the insulating seal body may be lower than that of the ceramic insulator. According to this aspect, since the specific dielectric constant of the insulating seal body is lower than that of the insulator, the electrostatic capacity is further reduced.

(4) In the above aspect, the insulating seal body may contain glass as a main component, and may be in contact with the center electrode. According to this aspect, since the insulating seal body is favorably fixed at the portion in contact with the center electrode, the impact resistance is improved.

(5) In the above aspect, the insulating seal body may contain a non-conductive transition metal oxide. According to this aspect, the fixing of the insulating seal body to the center electrode is further strengthened while securing insulating properties of the insulating seal body.

(6) In the above aspect, a thermal expansion coefficient of the insulating seal body may take a value between a thermal expansion coefficient of the center electrode and a thermal expansion coefficient of the ceramic insulator. In order to suppress cracks during manufacturing or use, the thermal expansion coefficient of the insulating seal body is preferably set so as not to deviate from the thermal expansion coefficient of the center electrode and the thermal expansion coefficient of the ceramic insulator. According to this aspect, the deviation can be prevented.

The present invention can be embodied in various manners other than the above-described ones. For example, the present invention can be embodied as a method for manufacturing a spark plug.

MODES FOR CARRYING OUT THE INVENTION

Figure 1:
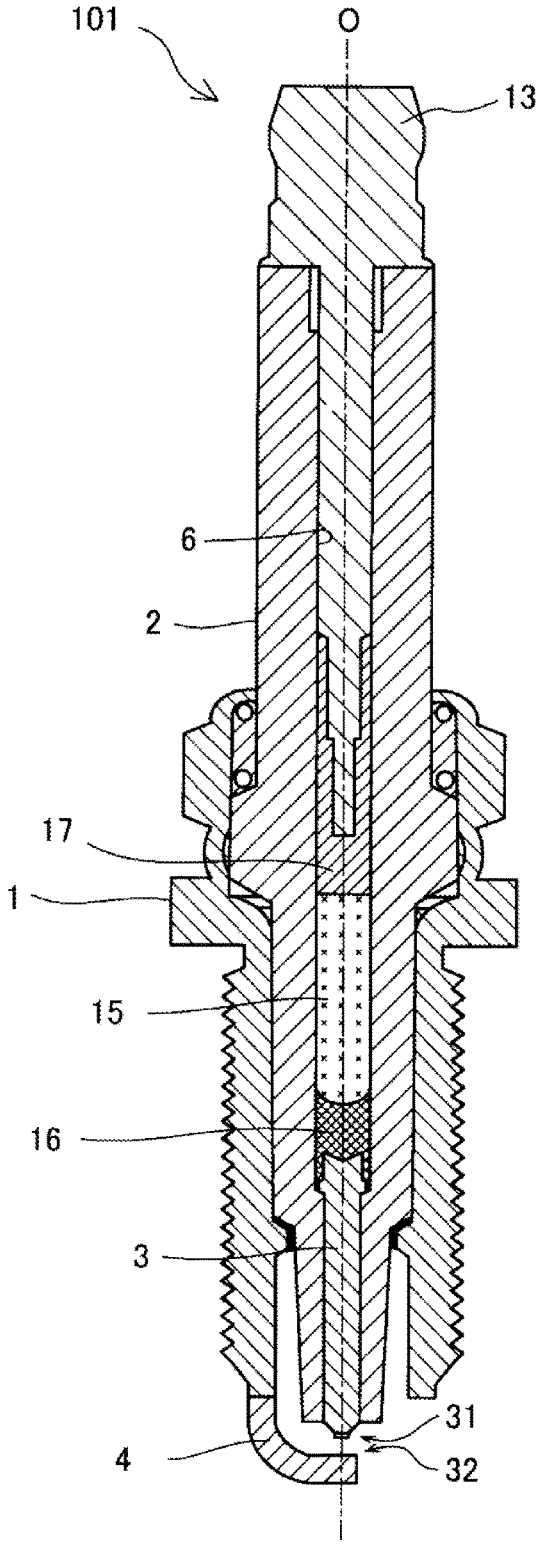
[FIG. 1] Cross-sectional view of a spark plug.

FIG. 1 is a cross-sectional view of a spark plug 101. The spark plug 101 includes a metal shell 1, a ceramic insulator 2, a center electrode 3, a ground electrode 4, and a metal terminal 13. In FIG. 1, the center, in the longitudinal direction, of the spark plug 101 is represented as an axis O. Along the axis O, the ground electrode 4 side is referred to as a front end side of the spark plug 101, and the metal terminal 13 side is referred to as a rear end side.

The metal shell 1 is formed from a metal such as carbon steel into a hollow cylindrical shape to form a housing of the spark plug 101. The ceramic insulator 2 is formed from a ceramic sintered body, and a front end side thereof is housed in the metal shell 1. The ceramic insulator 2 is a cylindrical member, and an axial hole 6 is formed therein so as to extend along the axis O. A part of the metal terminal 13 is inserted and fixed into one of end portions of the axial hole 6, and the center electrode 3 is inserted and fixed into the other of the end portions thereof. In addition, in the axial hole 6, a resistor 15 is arranged between the metal terminal 13 and the center electrode 3. Both end portions of the resistor 15 are electrically connected to the center electrode 3 and the metal terminal 13 via a seal layer 16 and a conductive glass seal layer 17, respectively, on a metal terminal side.

The resistor 15 functions as an electric resistance between the metal terminal 13 and the center electrode 3 to suppress generation of radio interference noise (noise) during spark discharge. The resistor 15 includes ceramic powder, a conductive material, glass, and a binder (adhesive). In the present embodiment, the resistor 15 is manufactured through a manufacturing procedure described below.

The center electrode 3 has a firing end 31 formed at a front end thereof, and is arranged in the axial hole 6 in a state where the firing end 31 is exposed. The ground electrode 4 is welded at one end thereof to the metal shell 1. In addition, the ground electrode 4 is arranged such that the other end portion of the ground electrode 4 is bent laterally and a front end portion 32 thereof opposes the firing end 31 of the center electrode 3 via a gap.

A screw portion is formed on the outer periphery of the metal shell 1 of the spark plug 101 having the above-described structure. The spark plug 101 is mounted to a cylinder head of an engine by using the screw portion.

Figure 2:
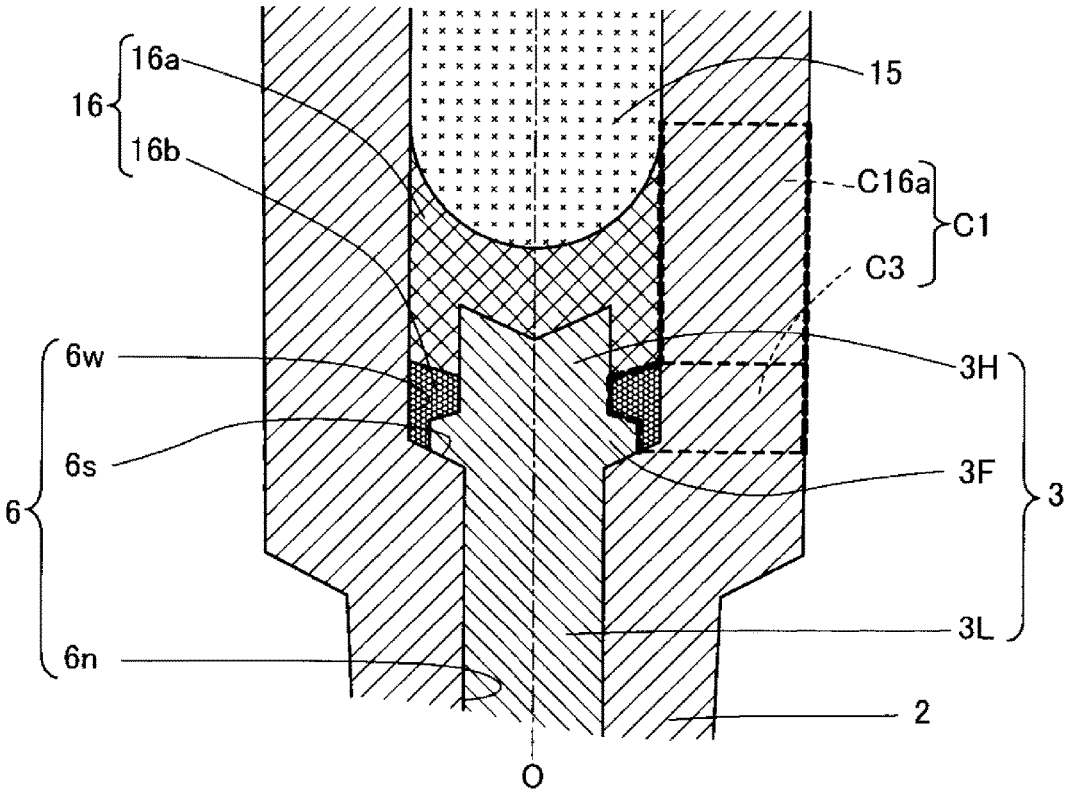
[FIG. 2] Enlarged cross-sectional view of a portion near a seal layer.

FIG. 2 is an enlarged cross-sectional view of a portion near the seal layer 16. The axial hole 6 includes a large-diameter portion 6*w* and a small-diameter portion 6*n*. The large-diameter portion 6*w* is larger in inner diameter than the small-diameter portion 6*n*. The large-diameter portion 6*w* includes a stepped portion 6*s*, and is connected to a rear end of the small-diameter portion 6*n* via the stepped portion 6*s*.

The center electrode 3 includes a flange portion 3F, a leg portion 3L, and a head portion 3H. The flange portion 3F projects in a radial direction in the large-diameter portion 6*w* to abut against the stepped portion 6*s*. The leg portion 3L extends from the flange portion 3F toward a front end side and is arranged in the small-diameter portion 6*n*. The head portion 3H extends from the flange portion 3F toward a rear end side.

The seal layer 16 includes a conductive glass seal layer 16*a* and an insulating glass seal layer 16*b*. The conductive glass seal layer 16*a* comes into contact with the head portion 3H and the resistor 15 to achieve electric connection between the center electrode 3 and the resistor 15.

The insulating glass seal layer 16*b* comes into contact with the ceramic insulator 2, the center electrode 3, and the conductive glass seal layer 16*a*. Contact portions of the ceramic insulator 2 with the insulating glass seal layer 16*b* are the large-diameter portion 6*w* and the stepped portion 6*s*. Contact portions of the center electrode 3 with the insulating glass seal layer 16*b* are the head portion 3H and the flange portion 3F. A contact portion of the resistor 15 with the insulating glass seal layer 16*b* is a forward facing surface. Thus, the seal layer 16 has a two-layer structure in which the conductive glass seal layer 16*a* is arranged on the rear end side and the insulating glass seal layer 16*b* is arranged on the front end side.

A main component of the insulating glass seal layer 16*b* is glass. The main component is a substance having a highest content. The insulating glass seal layer 16*b* contains at least one of nickel oxide (II) (NiO) and titanium dioxide ($TiO_2$). Nickel oxide (II) and titanium dioxide are both non-conductive transition metal oxides. In other words, the insulating glass seal layer 16*b* contains a non-conductive transition metal oxide.

A specific dielectric constant of the insulating glass seal layer 16*b* is lower than that of the ceramic insulator 2. In the present embodiment, the specific dielectric constant of the insulating glass seal layer 16*b* is 5.56, while the specific dielectric constant of the ceramic insulator 2 is 8.5.

A thermal expansion coefficient of the insulating glass seal layer 16*b* takes a value between thermal expansion coefficients of the ceramic insulator 2 and the center electrode 3. In the present embodiment, the thermal expansion coefficient of the ceramic insulator 2 is $7.2\times10^{-6}$/° C., and the thermal expansion coefficient of the center electrode 3 is $12\times10^{-6}$/° C. Therefore, the thermal expansion coefficient of the insulating glass seal layer 16*b* takes any value which is greater than $7.2\times10^{-6}$/° C. and less than $12\times10^{-6}$/° C.

The thermal expansion coefficient of the insulating glass seal layer 16*b* can be measured by cutting out only the insulating glass seal layer 16*b* from the spark plug 101. To measure the thermal expansion coefficient, for example, Thermo-mechanical Analysis (TMA) is used.

An electrostatic capacity C1 of a capacitor formed from a front end of the seal layer 16 in the direction of the axis O to a rear end thereof in the direction of the axis O is described. The capacitor is formed from the metal shell 1 and conductors (hereinafter, referred to as internal conductors) arranged in the ceramic insulator 2. The internal conductors are specifically the conductive glass seal layer 16*a* and the center electrode 3.

The electrostatic capacity C1 can be represented as C1=C3+Cl6*a*. An electrostatic capacity C3 is an electrostatic capacity of a capacitor in which the internal conductor is either one of the center electrode 3 and the conductive glass seal layer 16*a* and dielectrics are the ceramic insulator 2 and the insulating glass seal layer 16*b*. An electrostatic capacity Cl6*a* is an electrostatic capacity of a capacitor in which the internal conductor is the conductive glass seal layer 16*a* and a dielectric is the ceramic insulator 2. The electrostatic capacities C3 and Cl6*a* are in a relationship of parallel connection and, accordingly, when the capacities are added as described above, the result is equal to the electrostatic capacity C1 that is the combined value.

In general, an electrostatic capacity C of each of capacitors having coaxial cylindrical shapes is calculated by $C=2\pi\varepsilon L/\log(b/a)$. L denotes a cylindrical length in the axial direction, ε denotes a specific dielectric constant, a denotes an inner diameter of the cylindrical shape, and b denotes an outer diameter of the cylindrical shape. Thus, the less the specific dielectric constant ε is or the less the inner diameter a is in the case of the outer diameter b being constant, the less the electrostatic capacity C is.

In comparison with a comparative example where the entirety of the seal layer 16 is formed from the conductive glass seal layer 16*a*, the capacitor corresponding to the electrostatic capacity C3 is small in the head portion 3H corresponding to the inner diameter a and the outer diameter of the flange portion 3F. Accordingly, in comparison with the comparative example, the electrostatic capacity C3 is less in value than the electrostatic capacity of the capacitor at a position in the same axis O direction. As a result, the electrostatic capacity C1 is also less in value than that in the comparative example.

Further, the specific dielectric constant of the insulating glass seal layer 16*b* lower than that of the ceramic insulator 2 as described above contributes to reduction of the electrostatic capacity C3.

Figure 3:
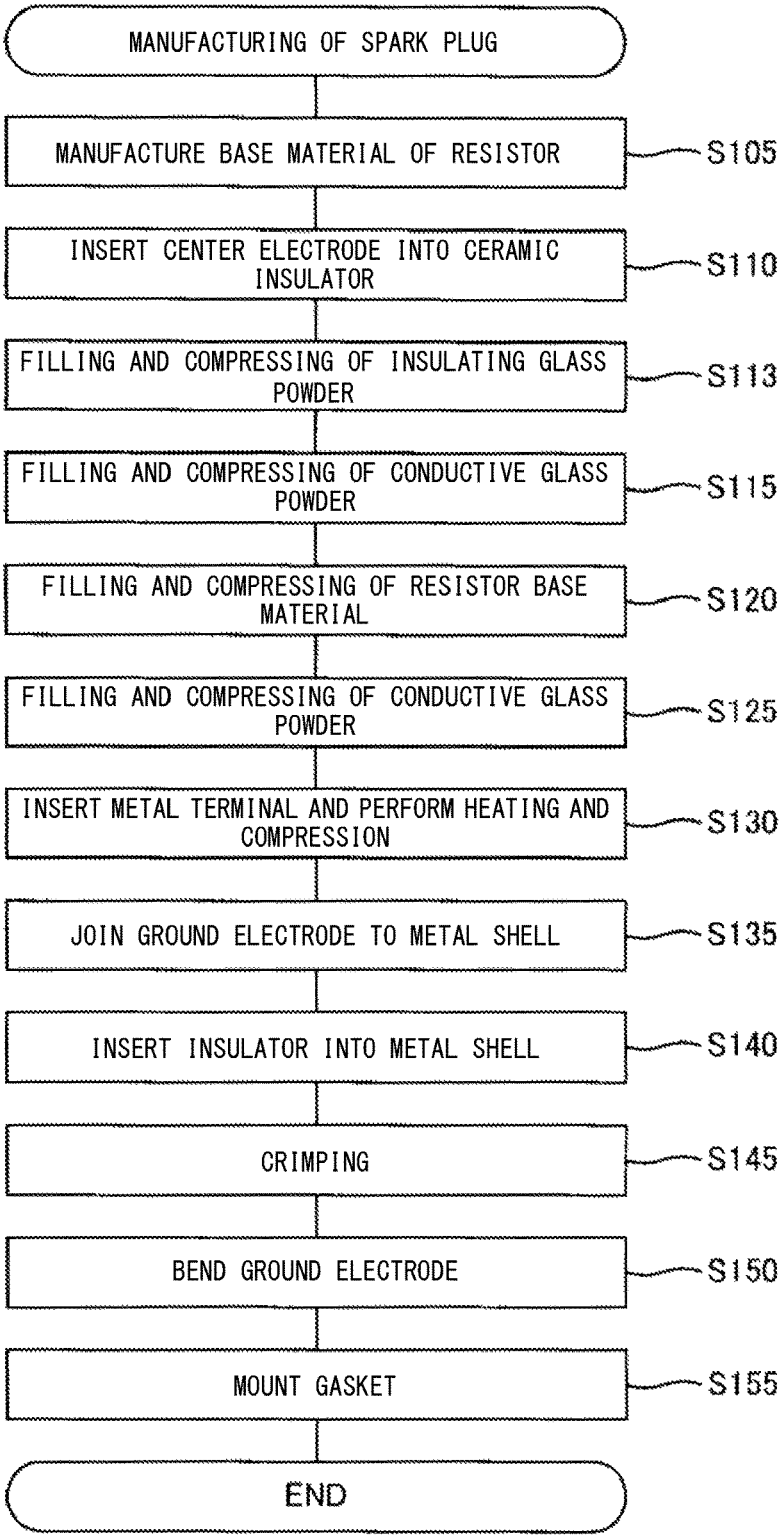
[FIG. 3] Flow chart showing a procedure for manufacturing the spark plug.

FIG. 3 is a flow chart showing a procedure for manufacturing the spark plug 101. Firstly, a base material of the resistor 15 is manufactured (S105).

Figure 4:
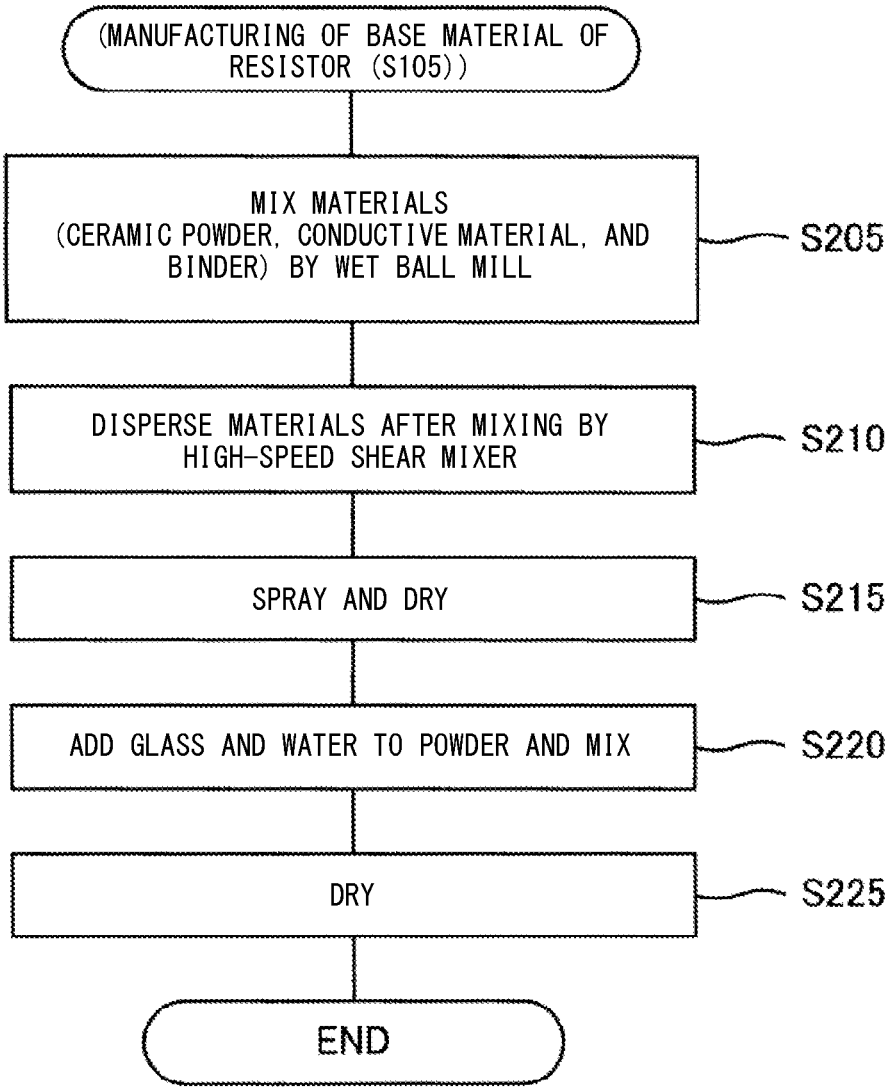
[FIG. 4] Flow chart showing a procedure for manufacturing a base material of a resistor.

FIG. 4 is a flow chart showing a procedure for manufacturing the base material of the resistor 15. Firstly, materials are mixed by a wet ball mill (S205). The materials are ceramic powder, a conductive material, and a binder. The ceramic powder is ceramic powder containing, for example, $ZrO_2$ and $TiO_2$. The conductive material is, for example, carbon black. The binder (organic binder) is, for example, a dispersant such as a polycarboxylic acid. Water is added as a solvent to the materials, and the materials are agitated and mixed by using the wet ball mill. At this time, while the materials are mixed, the degree of dispersion of the materials is relatively low.

Next, after the mixing, the materials are dispersed by a high-speed shear mixer (S210). The high-speed shear mixer is a mixer that mixes materials while greatly dispersing the materials by a strong shearing force by a blade (agitating blade). The high-speed shear mixer is, for example, an axial mixer.

Next, the materials obtained in S210 are immediately granulated by a spray-drying method (S215). Glass (coarse-grained glass powder) and water are added and mixed with the powder obtained in S215 (S220), and are dried (S225), thereby completing the base material (powder) of the resistor 15. As a mixer used for the aforementioned mixing in S220, for example, a universal mixer can be used.

Next, as shown in FIG. 3, the center electrode 3 is inserted into the axial hole 6 of the ceramic insulator 2 (S110). Subsequently, insulating glass powder is filled thereinto and compressed (S113). The compression is achieved by, for example, inserting a rod-shaped jig into the axial hole 6 and pressing the accumulated insulating glass powder. The jig has a recess provided in a compression surface in order to prevent interference with the head portion 3H. The recess has an inner diameter greater than the outer diameter of the head portion 3H, and a depth greater than the length of the head portion 3H. A layer of the insulating glass powder is formed into the insulating glass seal layer 16*b* through a heat compression step described below.

Next, conductive glass powder is filled into the axial hole 6 and compressed (S115). The compression is achieved by, for example, inserting a rod-shaped jig into the axial hole 6 and pressing the accumulated conductive glass powder. The jig used in S115 does not interfere with the head portion 3H, and accordingly no recess is provided. A layer of the conductive glass powder is formed into the conductive glass seal layer 16*a* through the heat compression step described below. The conductive glass powder is, for example, powder obtained by mixing copper powder and calcium borosilicate glass powder.

Next, the base material (powder) of the resistor 15 is filled into the axial hole 6 and compressed (S120). Further, conductive glass powder is filled into the axial hole 6 and compressed (S125). A layer of the powder formed in S120 is formed into the resistor 15 through the heat compression step described below. Similarly, a layer of the powder formed in S125 is formed into the conductive glass seal layer 17 on the metal terminal side through the heat compression step described below. The conductive glass powder used in S125 is powder of the same kind as the conductive glass powder used in S115. In addition, the compression method in S120 and S125 is similar to the compression method in S115.

Next, a part of the metal terminal 13 is inserted into the axial hole 6, and a predetermined pressure is applied from the metal terminal 13 side while heating the entirety of the ceramic insulator 2 (S130). Through the heat compression step, the materials filled into the axial hole 6 are compressed and sintered, thereby forming the conductive glass seal layer 16*a*, the insulating glass seal layer 16*b*, the conducive glass seal layer 17 on the metal terminal side, and the resistor 15 in the axial hole 6. As described above, the conductive glass seal layer 16*a* and the insulating glass seal layer 16*b* form the seal layer 16.

As described above, the thermal expansion coefficient of the insulating glass seal layer 16*b* takes the value between the thermal expansion coefficients of the ceramic insulator 2 and the center electrode 3. Thus, generation of cracks in S130 is suppressed.

Next, the ground electrode is joined to the metal shell 1 (S135), the ceramic insulator 2 is inserted into the metal shell 1 (S140), and the metal shell 1 is crimped (S145). Through the crimping step in S145, the ceramic insulator 2 is fixed to the metal shell 1. Next, a front end of the ground electrode joined to the metal shell 1 is bent (S150), thereby completing the ground electrode 4. Subsequently, a gasket (not shown) is mounted to the metal shell 1 (S155), thereby completing the spark plug 101.

The present invention is not limited to the embodiments, examples, and modified embodiments described in the present specification, and can be embodied in various configurations without departing from the gist of the present invention. For example, the technical features in the embodiments, examples, and modified embodiments corresponding to the technical features in each mode described in the Summary of the Invention section can be appropriately replaced or combined to solve some of or all of the foregoing problems, or to achieve some of or all of the foregoing effects. Such technical features may be appropriately deleted if not described as being essential in the present specification. For example, the following is exemplified.

The insulating glass seal layer 16*b* can be arranged anywhere as long as insulating glass seal layer 16*b* comes into contact with the ceramic insulator 2. For example, a three-layer structure may be adopted. The three-layer structure is a structure in which the conductive glass seal layer 16*a* is arranged as a first layer on a front end side, the conductive glass seal layer 16*a* is arranged as a third layer on a rear end side, and the insulating glass seal layer 16*b* is arranged as a second layer between the first layer and the third layer. The insulating glass seal layer 16*b* arranged in this manner also contributes to reduction of the electrostatic capacity C1.

Alternatively, the conductive glass seal layer 16*a* and the insulating glass seal layer 16*b* may be stacked in the radial direction. For example, the conductive glass seal layer 16*a* and the insulating glass seal layer 16*b* may be stacked as an inner layer and an outer layer, respectively. In this case, the conductive glass seal layer 16*a* may come into contact with the metal shell 1 or may not come into contact therewith.

As a material of the conductive glass seal layer 16*a*, a conductive substance other than copper powder may be used, or glass powder other than calcium borosilicate glass powder may be used. For example, as the conductive substance, carbon black or graphite powder may be used.

The thermal expansion coefficient of the center electrode 3 may be less than that of the ceramic insulator 2. In this case, the thermal expansion coefficient of the insulating glass seal layer 16*b* may take, as a value between the thermal expansion coefficients of the ceramic insulator 2 and the center electrode 3, a value which is greater than the thermal expansion coefficient of the center electrode 3 and less than the thermal expansion coefficient of the ceramic insulator 2.

DESCRIPTION OF REFERENCE NUMERALS

1: metal shell
2: ceramic insulator
3: center electrode
3F: flange portion
3H: head portion
3L: leg portion
4: ground electrode
5: screw portion
6: axial hole
6*n*: small-diameter portion
6*s*: stepped portion
6*w*: large-diameter portion
13: metal terminal
15: resistor
16: seal layer
16*a*: conductive glass seal layer
16*b*: insulating glass seal layer
17: conductive glass seal layer on metal terminal side
31: firing end
32: front end portion
101: spark plug

The invention claimed is:

1. A spark plug comprising:

a metal shell having an almost cylindrical shape and having a ground electrode on a front end side thereof;

a cylindrical ceramic insulator defining an axial hole therein and held in the metal shell, the axial hole having a small-diameter portion, a large-diameter portion that is larger in diameter than the small-diameter portion, and a stepped portion positioned between the large-diameter portion and the small-diameter portion;

a resistor arranged in the large-diameter portion;

a center electrode having a flange portion and a leg portion, the flange portion projecting in a radial direction in the large-diameter portion to contact with the stepped portion, the leg portion arranged in the small-diameter portion so as to extend from the flange portion toward the front end side; and a seal body arranged in the large-diameter portion and electrically connecting between the center electrode and the resistor, wherein the seal body includes a conductive seal body, and an insulating seal body that comes into contact with the ceramic insulator, and a thermal expansion coefficient of the insulating seal body takes a value between a thermal expansion coefficient of the center electrode and a thermal expansion coefficient of the ceramic insulator.

2. A spark plug according to claim 1, wherein the insulating seal body comes into contact with a forward facing surface of the conductive seal body.

3. A spark plug according to claim 1, wherein a specific dielectric constant of the insulating seal body is lower than that of the ceramic insulator.

4. A spark plug according to claim 1, wherein the insulating seal body contains glass as a main component, and is in contact with the center electrode.

5. A spark plug according to claim 1, wherein the insulating seal body contains a non-conductive transition metal oxide.

* * * * *